US005855435A

United States Patent [19]

Chiesa

[11] Patent Number: 5,855,435

[45] Date of Patent: Jan. 5, 1999

[54] OPENING AND CLOSING DEVICE FOR FLEXIBLE CONTAINERS AND CONTAINER PROVIDED WITH SUCH A DEVICE

[75] Inventor: Emilio Tessera Chiesa, Leumann, Italy

[73] Assignee: Sales S.p.A., Turin, Italy

[21] Appl. No.: 737,062

[22] PCT Filed: May 3, 1995

[86] PCT No.: PCT/EP95/01664

§ 371 Date: Jan. 10, 1997

§ 102(e) Date: Jan. 10, 1997

[87] PCT Pub. No.: WO95/30599

PCT Pub. Date: Nov. 16, 1995

[30] Foreign Application Priority Data

May 5, 1994 [IT] Italy ..... T094A0362

[51] Int. Cl.[6] ..... B65D 33/18

[52] U.S. Cl. ..... 383/204; 383/66; 383/78; 383/209

[58] Field of Search ..... 383/5, 66, 61, 383/78, 89, 88, 203, 204, 205, 207, 209, 210, 211

[56] References Cited

U.S. PATENT DOCUMENTS

| | | | |
|---|---|---|---|
| 3,711,011 | 1/1973 | Kugler | 383/205 X |
| 4,260,061 | 4/1981 | Jacobs | 383/203 |
| 4,428,477 | 1/1984 | Cristofolo | 383/89 X |
| 4,679,693 | 7/1987 | Forman | 383/203 |
| 4,709,399 | 11/1987 | Sanders | 383/66 |
| 4,838,429 | 6/1989 | Fabisiewicz et al. | 383/209 |
| 4,874,096 | 10/1989 | Tessera-Chiesa | 383/203 |
| 4,998,666 | 3/1991 | Ewan | 383/5 X |
| 5,310,262 | 5/1994 | Robison et al. | 383/205 |

FOREIGN PATENT DOCUMENTS

| | | | |
|---|---|---|---|
| 2652546 | 4/1991 | France | 383/66 |

*Primary Examiner*—Jes F. Pascua

*Attorney, Agent, or Firm*—Sughrue, Mion, Zinn, Macpeak & Seas, PLLC

[57] ABSTRACT

An opening and reclosing device for flexible containers, comprising a label having an adhesive face intended to be applied to a wall of the container in correspondence of a die-cut area thereof. The adhesive face is formed with two side-by-side sections the first of which is intended to detachably overlay the wall of the container along the die-cut area, and the second of which is constituted by a bi-adhesive strip which is detachable from the label and intended to permanently adhere to the wall of the container (1) in proximity of the die-cut area.

4 Claims, 3 Drawing Sheets

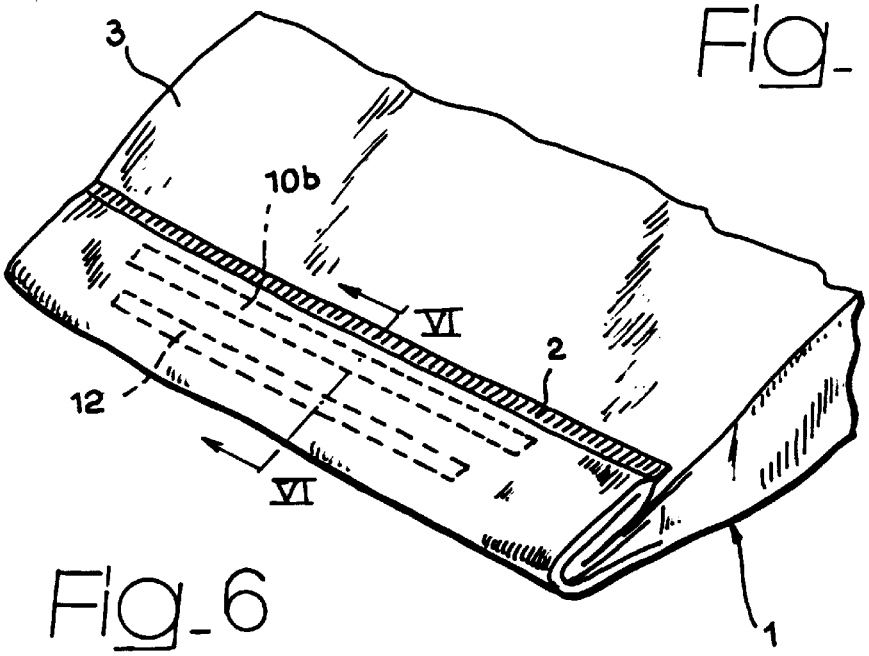
Fig_5
Fig_6
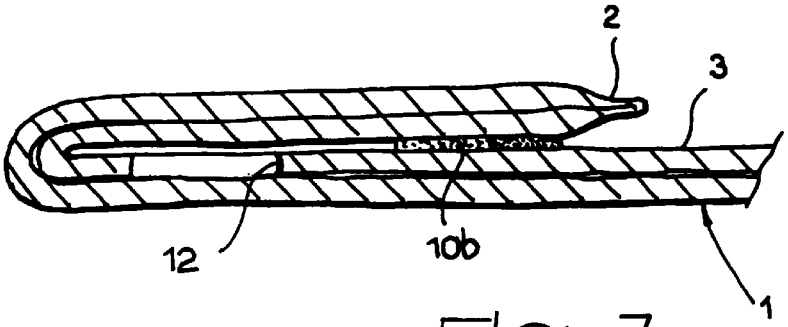
Fig_7
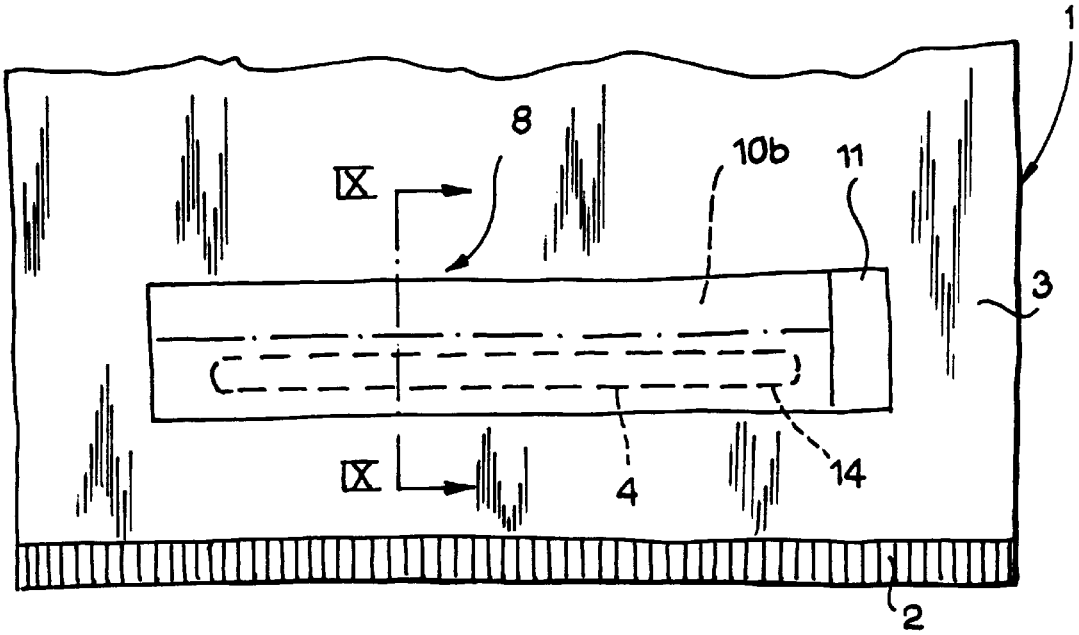

OPENING AND CLOSING DEVICE FOR FLEXIBLE CONTAINERS AND CONTAINER PROVIDED WITH SUCH A DEVICE

TECHNICAL FIELD

The present invention is related to an opening and reclosing device for flexible containers, for instance packets of plastic material or the like for bulk food products as well as for powder or liquid products.

These containers, sealed by the manufacturers, are opened for removal of the contents traditionally by cutting or tearing a top portion thereof, and cannot be subsequently closed again adequately so as to prevent or at least limit accidental coming out of the products.

BACKGROUND ART

More particularly, the invention refers to an opening and reclosing device comprising an adhesive flexible member to be applied onto the outer surface of one container wall in correspondence of a die-cut thereof. An opening and reclosing device of this kind is generally known from U.S. Pat. No. 4,874,096 owned by the same Applicant.

DISCLOSURE OF THE INVENTION

The object of the present invention is to provide a simple and cheap opening and reclosing device, which enables both to open the first time the container in a convenient and practical way, and to efficiently reclose the container following each removal of the contents.

A further object of the invention is to provide an opening and reclosing device which can be applied to the container in a simple and mechanized way.

According to the invention, the above objects are achieved by virtue of an opening and reclosing device of the above referenced type, primarily characterized in that the adhesive member comprises a label having an adhesive face intended to be applied over said die-cut area of the container wall, the adhesive face including two side-by-side sections the first of which is intended to detachably overlay the container wall along said die-cut area, and the second of which is constituted by a bi-adhesive strip which is detachable from the label and intended to permanently adhere to the container wall in proximity of said die-cut area.

Due to this idea of solution, the first opening of the container can be performed by the user simply following removal of the adhesive label so as to allow access to the contents through the die-cut area of the container.

As a consequence of the removal of the label, the bi-adhesive strip which remains adherent to the container enables reclosing thereof, following simple folding of an edge portion of the container beyond the die-cut area so as to attach this edge portion over the container by means of the bi-adhesive strip. Following each subsequent re-opening, the container can be readily reclosed in the same way.

Preferably the label is transparent: this allows, through a peculiar design of the die-cut area on the container wall, to provide an immediate visual indication related to the container having been opened at least once. This can be achieved, for instance, forming the die-cut area of the container wall with a number of slits spaced apart from one another and delimiting a releasable strip of a shorter length than the label, with each slit being separated from the adjacent ones through preferential breakage areas. Accordingly, when the container is opened for the first time, the strip delimited by the slits is removed along with the label: when the latter be subsequently re-applied, ready visual indication shall be obtained of the fact that the strip has already been separated from the remainder of the container wall.

BRIEF DESCRIPTION OF THE DRAWINGS

The invention will now be disclosed in detail with reference to the accompanying drawings, purely provided by way of non limiting example, in which:

FIG. 5 is a view similar to FIG. 4 showing the re-closed condition of the container, FIG. 6 is a sectioned and enlarged view along line VI—VI of FIG. 5, FIG. 7 is a plan view of a second embodiment of the device according to the invention.

PREFERRED EMBODIMENTS OF THE INVENTION

Figure 1:
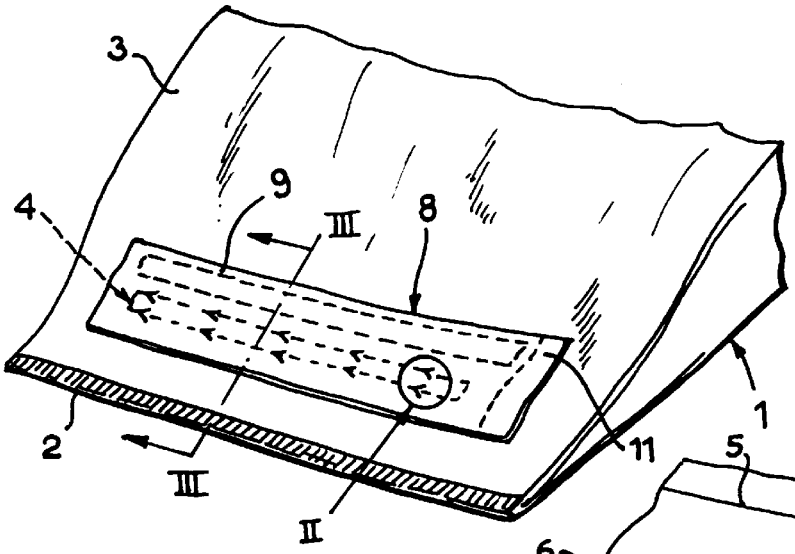
FIG. 1 is a diagrammatic perspective and partial view of a flexible container provided with an opening and reclosing device according to the invention.
Figure 2:
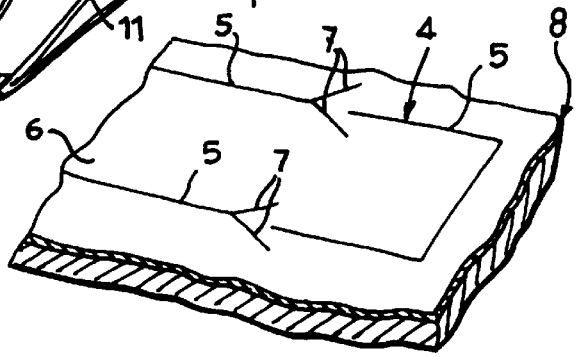
FIG. 2 is a fragmentary and enlarged view of the detail indicated by arrow II in FIG. 1.
Figure 3:
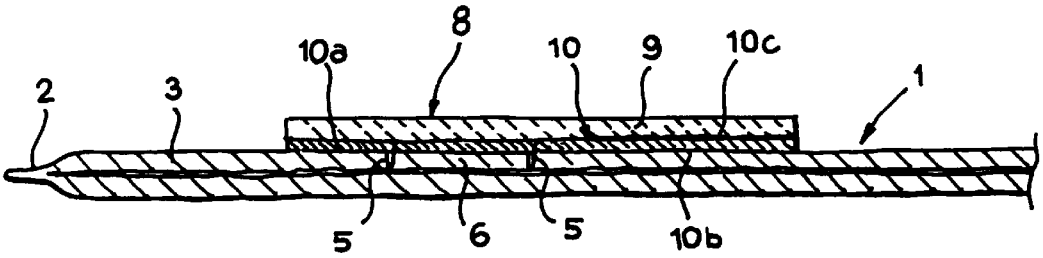
FIG. 3 is a cross sectioned and enlarged view along line III—III of FIG. 1.

Referring initially to FIGS. 1 through 3, reference numeral 1 generally designates a flexible container, for instance constituted by a sealed packet normally made of thermoplastic material or plasticized paper, which is intended to contain bulk food products (or even powders or liquids). The container 1 has one end 2 sealed by means of heat welding or glueing, and is provided on one of its walls 3 with a die-cut area 4 adjacent and parallel to the sealed end 2.

The die-cut area 4 may simply be constituted by a single elongated slot or, as in the case of the shown example, it may be formed by a series of slits 5 spaced apart from one another and delimiting a removable strip 6 having a rectangular shape. In this case pairs of V-shaped cuts 7 are formed between the adjacent slits 5, which are defining a preferential breakage pattern of the wall 3.

Reference 8 designates a label also having a rectangular elongated shape, whose length is greater than that of the die-cut area 4, and which is preferably but not necessarily transparent. The label 8 comprises a support sheet 9 of paper or plastic material, having an adhesive face 10 defined by two side-by-side adhesive films or layers 10*a*, 10*b* extending parallelly to the longitudinal extension of the label 8 and the first of which is permanently adhered to the support sheet 9, and the second of which is bi-adhesive and is detachably connected to the support sheet 9, through the interposition of a silicone layer 10*c* or the like.

Moreover the label 8 has a non-adhesive end 11 defining a gripper portion.

The label 8 is applied onto the wall 3 of the container 1 so that the adhesive section 10*a* thereof completely overlays the die-cut 4, while the bi-adhesive section 10*b* thereof adheres to an area of the wall 3 adjacent and parallel to the die-cut 4. This area is most conveniently the one located, with respect to the die-cut 4, on the side opposite to the end 2 of the container 1.

Figure 4:
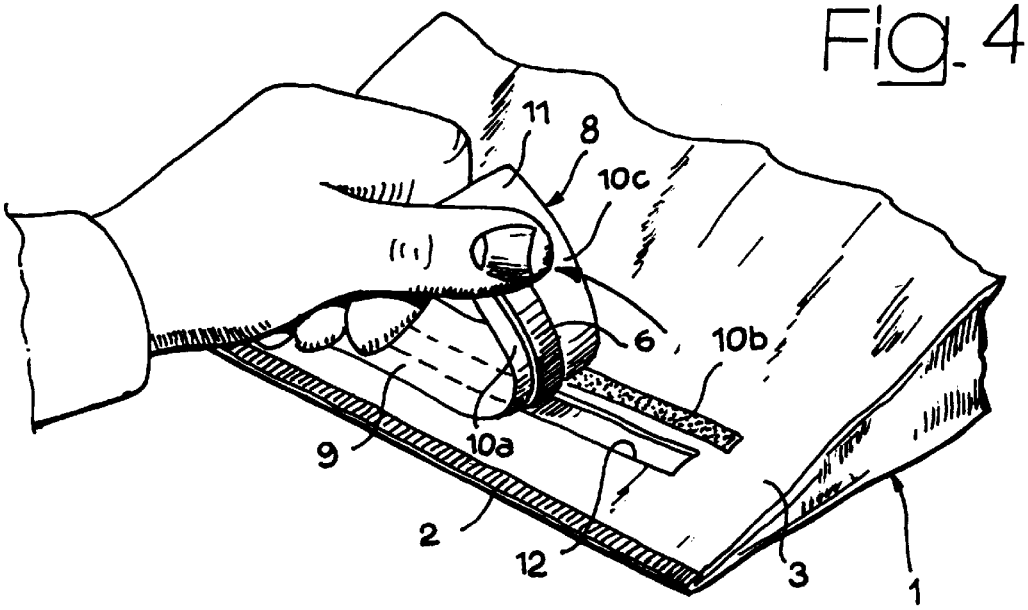
FIG. 4 is a perspective view showing the opening phase of the container.

FIGS. 4 through 6 show the way of opening and reclosing the container 1.

At the time of the first opening, it is sufficient, after manually gripping the non-adhesive end 11, to detach the label 8 from the wall 3 of the container 1. The contents therein is thus accessible through the die-cut 4: if the latter is constituted by a mere slot, the contents can be removed through this slot exposed following release of the label 8. If on the contrary the die-cut is formed such as previously disclosed, the detachment of the label 8 will cause removal of the strip 6, by virtue of the breakage of the wall in the areas comprised between the slits 5, so as to generate 6 corresponding elongated quadrangular aperture 12.

When the label 8 is thus removed, the bi-adhesive layer 10*b* is separated from the support sheet 9, thus remaining permanently anchored on the wall 3, aside the aperture 12 (FIG. 4).

According to the above disclosed arrangement, if the label 8 is transparent and in case the latter is re-applied onto the wall 3 for instance following an unauthorized removal of part of the products from the container, a clear visual indication shall be provided of the opening having occurred, due to breakage of the areas corresponding to the cuts 7, and in any case due to a re-positioning of the strip 6 for sure different from the original one, i.e. prior to removal of the label 8.

Reclosing of the container 1 is simply performed by folding the end 2 over the aperture 12 and adhesively attaching it onto the bi-adhesive layer 10*b* (FIGS. 5 and 6;. Undesired outlet of the contents of the container is thus prevented following obstruction of the aperture 2 by the folded end 2, and for a subsequent reopening it is then sufficient to detach the latter from the bi-adhesive layer 10*b*.

Accordingly, the container 1 can be opened and reclosed several times, until depletion of the contents.

Figure 8:
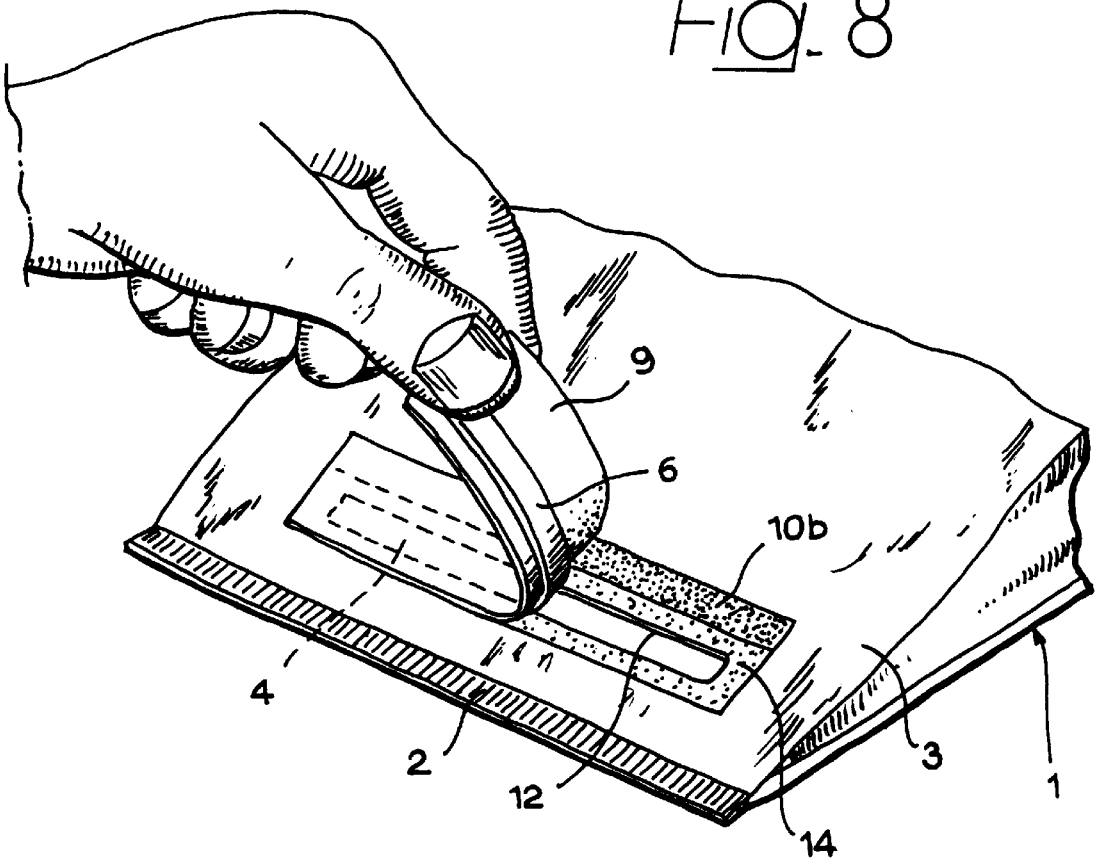
FIG. 8 is a perspective view showing the opening phase of the container provided with the device according to FIG. 7.
Figure 9:
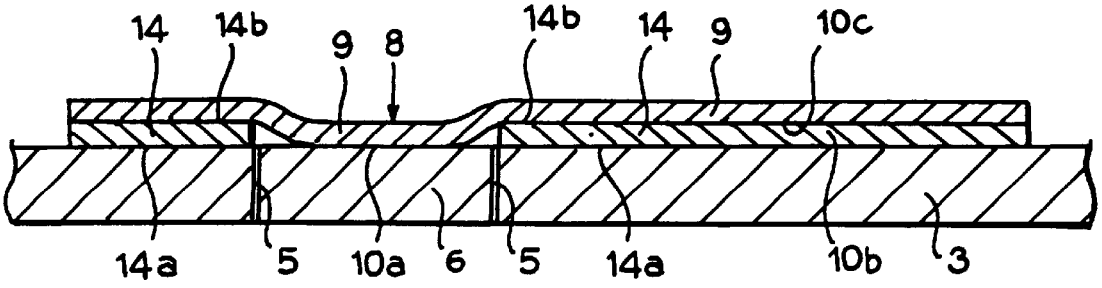
FIG. 9 is a diagrammatic section along line IX—IX of FIG. 7.

An alternative embodiment of the device according to the invention is shown in FIGS. 7, 8 and 9. Parts corresponding to those already disclosed in the above are indicated by the same numeral references.

Reverting to FIGS. 7 through 9, the label 8 is provided with a reinforcement portion 14 arranged on one side of the bi-adhesive layer 10*b* and having a frame configuration surrounding the die-cut area 4 formed in the wall 3 of the container.

The reinforcement portion 14 has an inner adhesive surface 14*a* and an outer siliconed surface 14*b* contacting the adhesive face 10*a* of the support sheet 9 of the label 8.

As shown in FIG. 8, upon removal of the support sheet 9, the reinforcement portion 14 remains adherent to the wall 3 together with the bi-adhesive layer 10*b*. The strip 6 remains adherent to the adhesive face 10*a* of the support sheet 9 and is removed together with the latter same as previously disclosed.

The portion 14 constitutes a reinforcement of the wall 3 in order to prevent breakage and tearing thereof beyond the boundary of the initial aperture.

Naturally the details of construction and the embodiments may be widely varied with respect to what has been disclosed and illustrated, without thereby departing from the scope of the present invention such as defined in the appended claims.

What is claimed is:

1. A flexible container provided with an opening and re-closing device, said flexible container having a die-cut area, said device comprising a flexible member adapted to be adhesively secured onto an outer surface of one wall of the container in overlying relation to said die-cut area, said flexible member being comprised of a label having first and second side by side adhesive layers on one face thereof, said first layer having a first adhesive means on a first surface permanently secured to said label and a second adhesive means on a second surface detachably secured to said wall of the container over said die-cut area and said second layer having a first adhesive means on a first surface permanently adhered to said container wall adjacent the die-cut area and a second adhesive means on a second surface detachably connected to said label whereby the label is adapted to be completely removed from the container.

2. Container according to claim 1, characterized in that said die-cut area of said one wall of the container is formed in proximity of and parallel to one end of the container, and in that said second layer of said label is adhered to said wall parallel to said die-cut area and on the side thereof opposite to said end of the container.

3. Container according to claim 2, characterized in that said die-cut area is formed by a slot having a shorter length than the label.

4. Container according to claim 2, characterized in that said die-cut area is formed by a number of slits spaced apart from one another and delimiting a removable strip having a shorter length than the label, each slit being separated from adjacent slits via preferential breakage patterns.

* * * * *